US006326728B1

(12) United States Patent
Cheng et al.

(10) Patent No.: US 6,326,728 B1
(45) Date of Patent: Dec. 4, 2001

(54) TYPE OF LIGHT

(76) Inventors: Lu Li Cheng; Chen Yu Chien, both of No. 11, Lane 378, Chung Shan Rd., Hsinchu (TW)

( * ) Notice: Subject to any disclaimer, the term of this patent is extended or adjusted under 35 U.S.C. 154(b) by 0 days.

(21) Appl. No.: 09/411,336

(22) Filed: Oct. 1, 1999

(51) Int. Cl.[7] ..... H01K 1/00
(52) U.S. Cl. ..... 313/623; 313/578; 315/74
(58) Field of Search ..... 313/623, 578, 313/271; 315/74

(56) References Cited

U.S. PATENT DOCUMENTS 3,654,512 * 4/1972 Spiteri ..... 313/578 X
5,384,510 * 1/1995 Arnold ..... 313/578 X
5,910,707 * 6/1999 Bell ..... 313/578 X

* cited by examiner

*Primary Examiner*—Ashok Patel

(57) ABSTRACT

A new type of light comprises a casing used for containing an emitting device. Further, the emitting device comprises a couple of wires, an insulator ball, a filament and a fuse. The couple of wires are connected with a power supply via the casing, wherein the contact ponts of wires and casing are defined as the bottom of the light. Moreoever, the insulator is positioned above the bottom of the light. Subsequently, the filament is position above the insulator ball, and the fuse is posted on the top of wires. Particularly, the tops of the wires are wound to form hooks to hold the fuse. The hooks are flattened for increasing the adhesion of connection between the wires and the fuse.

5 Claims, 2 Drawing Sheets

TYPE OF LIGHT

FIELD OF THE INVENTION

The present invention generally relates to a new type of light, and more particularly, relates to a new type of light comprising a filament, a fuse, a couple of conductors and an insulator. Further, the relative position between the filament and the fuse is changed to improve the reliability of the light.

BACKGROUND OF THE RELATED ART

Since T.A. Edision disclosed the first light in the 1880s, many kinds of illuminations have been used, thus allowing life at night to become diversified. The illuminations are used for adornment and in brightening. The power of light emitted is qualified as Ohm's law as $W=V^2/R$, wherein the V is denoted as the loading voltage of the circuit and R stands for resistance. Otherwise, the principle light emitting is indicated as the "Black body emission" principle. The principle indicates the relationship between the wavelength of emitted light and the temperature of the emitting source (for example, the human being emits the IR at room temperature). Hence, visible light can be generated by using a suitable material, such as tungsten, which the tungsten is preferably heated to about 3,000° C. The suitable material must be chemically stable at a high temperature. Referring to FIG. 1 is a cross-sectional view of a conventional light 10 is shown therein.

More complex structures of light, such as a light containing a fuse, have been developed. The fuse of the light is used to prevent the excess use of electric power. The light containing the fuse is shown as FIG. 2. The light 20 is composed of a tungsten wire 23, a fuse 25, an insulator 24 and a couple of wires 22 . All of the elements of the light 20 are contained in a casing 21. All of the elements are mounted in the following sequence: The couple of wires 22 are fitted through the bottom of the casing 21 wherein the pinnacles of the couple of wires 22 are formed as hooks. Further, the filament 23 is hooked between the hooks of the couple of wires 22. Moreover, a fuse 25 is wound around the couple of wires 22 for protecting the circuit, wherein the position of the fuse 25 is under the filament 23. In a string of lights, one or more lights fail due to all of the lights on the circuit of the string. The fuse 25 is used for preventing all of the lights on the string from being disabled. For insulation, an insulator ball 24 is used between the couple of the wires for a fixing purpose.

In the light 20 described above, the fuse 25 is usually wound around the couple of wires 22. The fuse 25 may loosen when the filament is heated at high temperature. When the lights of ornaments are unavoidably shifted, the wires are easily loosened with the wires 22.

SUMMARY OF THE INVENTION

According to one aspect of the invention, there is provided a new type of light. The disclosed new type of light has the excellent coupling reliability of the fuse. Therefore, the light of the present invention has the advantage of preventing vibration of the surroundings.

In another embodiment of the present invention, the light is also composed of an insulator ball at the bottom, a filament disposed atop of the conductive wires, a fuse disposed between the insulator ball and the filament. In order to prevent loosing of the fuse, the fuse is fastened in one end with two spiral circles for clockwise direction and another end with two spiral circles for counterclockwise direction.

The above and other features, particularly, and the advantages of the invention will be more readily apparent from the reading of the following detailed description of the invention taken in conjunction with the accompanying drawings.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
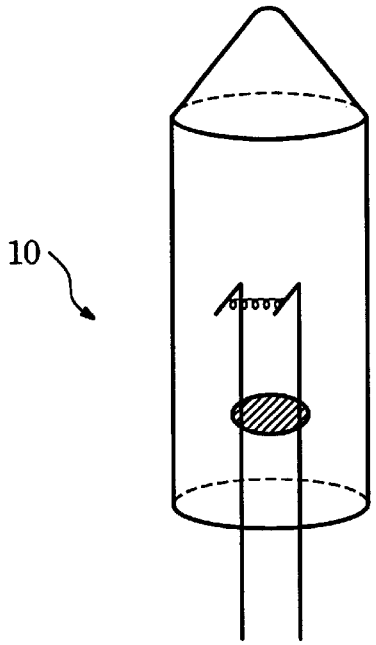
Fig.1 ( Prior Art )
FIG. 1 shows a cross-sectional view of an original light.
Figure 2:
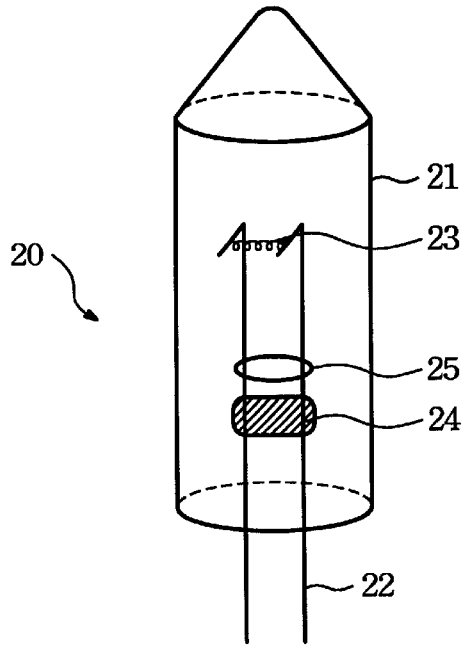
Fig.2 ( Prior Art )
FIG. 2 shows a cross-sectional view of a prior art of a light with a fuse.
Figure 3:
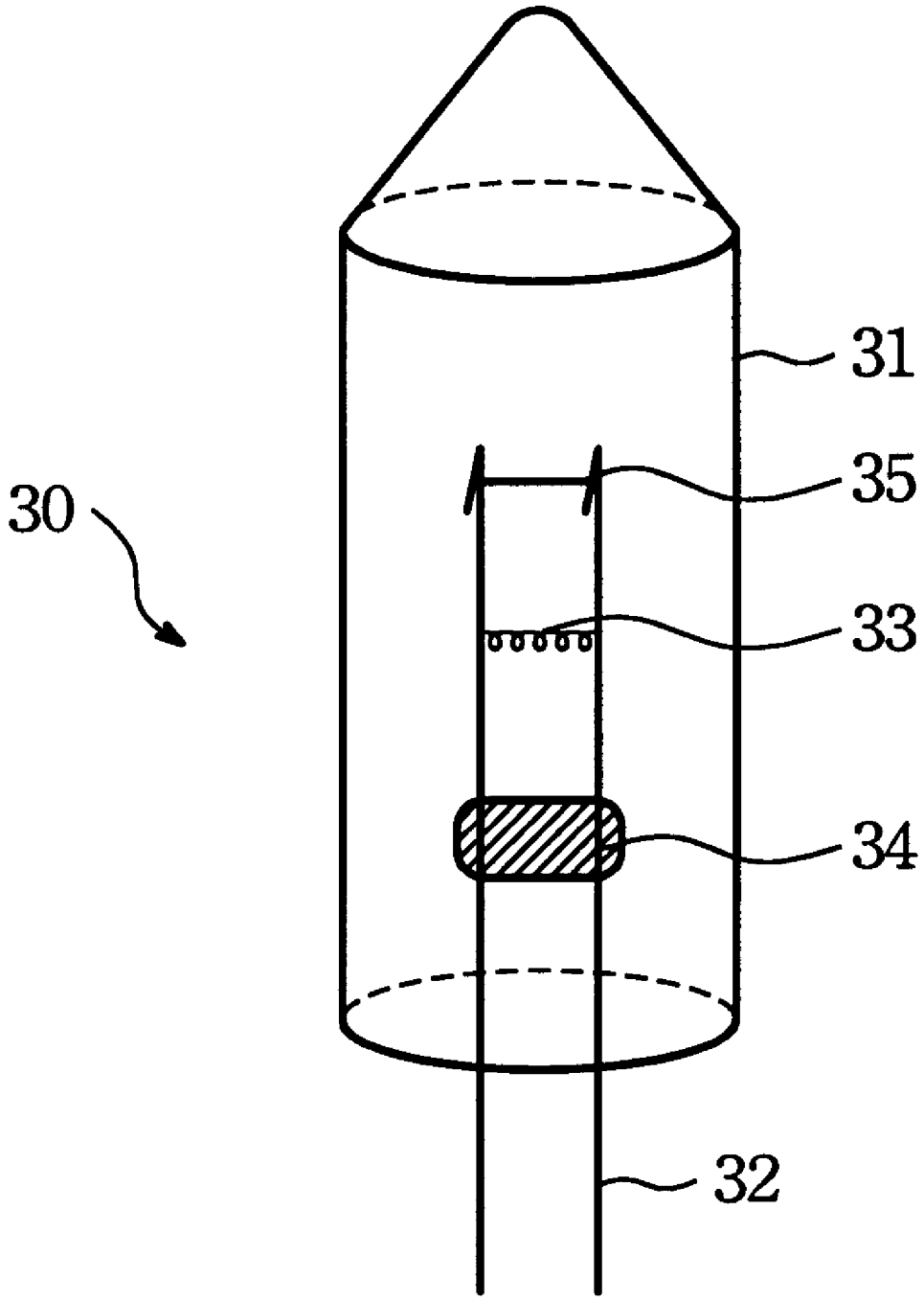
FIG. 3 shows a cross-sectional view of the light according to the present invention.

Referring to FIG. 3, the light 30 according to the present invention is composed of a filament 33, a fuse 35 and an insulator ball 34 wherein all of them are connected between a couple of wires 32. Further, all of the components are contained in a glass-casing 31, and the couple of wires 32 are connected to a power supply through the casing 31.

According to the present invention, the casing 31 can be the material selected from a group consisting of glass, colored glass and any kind of color plastic casings. The casing contains an emitting device which will radiate a light beam, a couple of wires 32 extending from the casing 31 and coupled to the power supply. The wires can be formed by an alloy, such as copper and magnesium.

The emitting device in the casing 31 consists of the couple of wires 32 wherein an insulator ball 34 is located at the lower end of the wires 32 near bottom of the casing 31 and space apart the wires 32 to provide insulation of the wires 32, a fuse 35 is located atop the wires 32, and a filament 33 is disposed between the insulator ball 34 and the fuse 35. The connecting points of the wires 23 and casing 31 are defined as the bottom of the light 30. The detailed position of the components of the emitting device is as following: The insulator ball 34 is selected from a group consisting of glass, ceramic or plastic. Successively, the filament 33 is positioned about 5–10 mm above the insulator ball 34. Finally, the fuse 35 is positioned on the top of the couple of wires 32 wherein the top of wires are wound as hooks to connect to the fuse 35, and the distance between the top of wires 32 and filament 33 is about 3–4 mm. In order to fasten the fuse 35 and wires 32, the hooks are pressed and flattened. By pressing the hooks of the wires 32, the connecting function between the fuse 35 and wires 32 become more rigid. According to the first embodiment of the present invention, the reliability of the connection between fuse 35 and wires 32 is increased. Therefore, the problem of the conventional ornamental lights that easily fail according to the vibrations from the surroundings can be resolved.

Referring now to FIG. 4, the figure shows a second embodiment of the present invention. Due to the unreliable fixing of the fuse of the conventional light, the present embodiment introduces a new structure to fix the fuse 35. In this figure, the emitting device also includes a pair of wires 32 disposed within the casing 31. The insulator ball 34 separated the wires 32 and is positioned about 10–20 mm from the bottom of the light 30. Next, the filament 33 is located atop the wires 32 and fixed according to the conventional method. Moreover, the fuse 35 is configured above the insulator ball 34 about 5–10 mm. The winding method of the fuse 35 is as follows: One end of the fuse 35 winds on one of the wires 32 with two spiral circles in clockwise direction, the other end of the fuse 35 winds on another one of the wires 32 also with two spiral circles, but in counter-clockwise direction.

By using the new structure of the light conventional failure mode of disconnecting is also avoided. Furthermore, since the length of the fuse 35 according to the second embodiment of the present invention is much shorter than conventional light, power consumption of the present invention can be reduced.

However, the sizes described above are an example such as an ornament light in celebration, and the present invention would be constructed according to the desired sizes. While the preferred embodiment of the invention has been illustrated and described, it will be appreciated that various changes can be made therein without departing from the spirit and scope of the invention.

What is claim is:

1. A new type of light comprising:

a casing;

an emitting device for encapsulating inside said casing comprising:

a couple of wires being extended from outside of said casing to inside of said casing, and a bottom of said light is defined as the connection points of said wires and casing, further, the top of said couple of wires are formed as hooks;

an insulator ball being posited above said bottom of said light for used to fitting said couple of wires;

a filament being posited above said insulator ball for connecting with said couple of wires; and a fuse being posited on said top of said couple of wires and being hooked on top of said couple of wires by said hooks.

2. The light according to claim 1, wherein said casing is selected from a group consisting of glass and plastic.

3. The light according to claim 1, wherein said couple of wires is formed by alloy.

4. The light according to claim 3, wherein said alloy is composed of copper and magnesium.

5. The light according claim 1, wherein said insulator ball is selected from a group consisting of glass, plastic and ceramic.

* * * * *